US007852326B2

(12) United States Patent
Lin et al.

(10) Patent No.: US 7,852,326 B2
(45) Date of Patent: Dec. 14, 2010

(54) DISPLAY METHOD

(75) Inventors: Chao-Lien Lin, Tainan County (TW); Fu-Cheng Chen, Tainan County (TW); Chung-Kuang Wei, Tainan County (TW)

(73) Assignee: Chi Mei Optoelectronics Corp., Tainan (TW)

( * ) Notice: Subject to any disclaimer, the term of this patent is extended or adjusted under 35 U.S.C. 154(b) by 1379 days.

(21) Appl. No.: 11/220,084

(22) Filed: Sep. 6, 2005

(65) Prior Publication Data

US 2006/0050049 A1 Mar. 9, 2006

(30) Foreign Application Priority Data

Sep. 7, 2004 (TW) ..... 93126969 A

(51) Int. Cl.
*G06G 5/00* (2006.01)

(52) U.S. Cl. ..... 345/204; 345/88; 345/89; 345/102; 345/690

(58) Field of Classification Search ..... 345/88, 345/89, 102, 204, 690
See application file for complete search history.

(56) References Cited

U.S. PATENT DOCUMENTS

| | | | | |
|---|---|---|---|---|
| 6,965,367 | B2 * | 11/2005 | Tanaka et al. | 345/102 |
| 7,248,244 | B2 * | 7/2007 | Akiyama | 345/102 |
| 2006/0284894 | A1 * | 12/2006 | Johnson et al. | 345/690 |

FOREIGN PATENT DOCUMENTS

| | | |
|---|---|---|
| JP | H09-006287 | 1/1997 |
| JP | 2002-82326 | 3/2002 |

* cited by examiner

*Primary Examiner*—Lun-Yi Lao
*Assistant Examiner*—Solomon Berhane

(57) ABSTRACT

A display method used for a display which has a backlight module suitable to provide more than M types of primary color lights, where M=3. The display panel of the display has an array of pixel regions. The display method provides these pixels regions to display multiple image data to be display in multiple frame times. Each of the image data includes ($L1_N$, $L2_N$, . . . , $LM_N$) each representing the brightness of the M primary color light in each pixel region, where N is a positive integer. The backlight module sequentially provides M-1 primary color lights within any two successive frame times, so allow the image data to drive the pixel regions. The first and the $M^{th}$ primary color lights provide the frame times for these two successive frame times.

19 Claims, 4 Drawing Sheets

DISPLAY METHOD

BACKGROUND OF THE INVENTION

1. Field of Invention

The present invention relates in general to a display method, and more particular, to a display method operative to perform full-color display based on integration of various colors of backlight without using color filters.

2. Related Art

The fast developments of media are basically benefited by the advancement of semiconductor devices and human-machine display apparatus. For the display market, the cathode ray tube used to dominant products because of the high display quality and the economic value. However, the growth of personal desktop terminal/display has raised great environmental and power saving concerns. The power consumption and large size of the cathode ray tube gradually caused the displays based thereon replaced by the light, thin, short, small, low power consumed, and radiation-free liquid crystal displays.

Referring to FIGS. 1 and 2, the liquid crystal display 100 includes a backlight module 110 and a liquid crystal panel 120. The liquid crystal panel 120 is mounted on the emerging surface 112 of the backlight module 110. The liquid crystal panel 120 includes an active device array substrate 130, a color filter substrate 140 and a liquid crystal layer 150 sandwiched between the active device array substrate 130 and the color filter substrate 140. The picture displayed by the liquid crystal display is constructed by an array of pixels 160 each is arranged with three sub-pixels in the form of red, green and blue color thin-films 162, 164 and 166. The color displayed by each of the pixels 160 is determined by the light emitted by the backlight module 110 and propagating through the color thin-films.

In the current display methods of liquid crystal display, the array technique is the most commonly used. The array technique uses a backlight module 110 to provide white light W filtered by the color thin-films of the sub-pixels 162, 164 and 166 into red light, green light and blue light. By controlling the twisting angles of the liquid crystal molecules, the transmission rates of the sub-pixels 162, 164 and 166 for each pixel 160 can thus be adjusted to provide a resulting color mixed by various intensities of red light, green light and blue light. Referring to FIG. 3, the x-axis indicates the spatial ratio of each color image, and y-axis indicates the frame time ratio of each image. As shown in the conventional display method, each color thin-film occupies ⅓ of each pixel, such that the spatial utility for each color image is limited to ⅓.

To resolve such issue, a color sequential display method has been proposed. In the liquid crystal display using color sequential method, the cold cathode fluorescent lamp (CCFL) of the backlight module is operative to emit red, green and blue color light without using the color thin films, and the three primary lights can be switched quickly. The vision persistence of human eyes and the high frequency switching speed of the cold cathode fluorescent lamp between three primary colors allow the human to visualize full color picture. Referring to FIG. 4, the x-axis indicates the spatial occupancy of each color image, and the y-axis indicates the occupancy of each color image in each unit frame time. As shown in FIG. 4, to provide a fluent frame (for example, to have the same length of unit frame time of the conventional array method), the scan frequency of the liquid crystal display using the color sequential method is three times of that required by the liquid crystal display using array method. The complexity for fabricating such type of liquid crystal display is thus three times of that for the liquid crystal display using array method.

SUMMARY OF THE INVENTION

A display method suitable for enhancing the spatial utilities of various colors in the display is provided. The display method can thus reduce the scan frequency of the backlight module.

In the first aspect, the display method includes a backlight module operative to provide M types of primary color lights (M is a positive integer no smaller than 3) and a display panel including an array of a plurality of pixel regions.

Firstly, the display method provides a plurality of image data to each of the pixel regions within N frame times (N is a positive integer). Each of the image data provided to the $N^{th}$ frame time includes M types of primary color lights with brightness expressed as $L\mathbf{1}_N, L\mathbf{2}_N, \ldots, LM_N$.

Secondly, the display method rearranges the M types of primary color lights provided to the consecutive frame times. Such that, each of the frame times includes only M-1 types of primary color lights, and the M-1 types of primary color lights are provided with alternate color sequences (1, 2, . . . , M-1) and (M, M-1, . . . , 2) for the first to the $N^{th}$ frame time to drive the pixel regions.

As the backlight module sequentially provides M-1 primary color lights within any two successive frame times, the primary color lights in the first and the second sequence have brightness adjusted as $(L\mathbf{1}_{N+1}+L\mathbf{1}_N), L\mathbf{2}_N, \ldots, L(M-1)_N)$ and $((LM_N+LM_{N+1}), L(M-1)_{N+1}, \ldots, L\mathbf{2}_{N+1})$, respectively, after propagating through the display panel.

Moreover, the primary color lights, for example as M=4, may include red light, blue light, green light and cyan light. As the backlight module provides M-1 types of primary color lights in each of the frame times, the time occupied for each primary color light can be the same or different.

In the second aspect, the display method for use in a display has a backlight module and a display panel. The backlight module is operative to provide at least a first, a second and a third primary color lights, and the display panel comprises an array of a plurality of pixel regions.

Firstly, the display method provides a plurality of image data to the pixel regions within a plurality of frame times. Each of the image data includes a brightness $L\mathbf{1}_N, L\mathbf{2}_N, L\mathbf{3}_N$ at the pixel regions for the $N^{th}$ time frame, where N is a positive integer.

Secondly, the display method provides the three primary color lights to the frame times with the sequence of (first color, second color) and sequence (third color, second color) sequentially and driving the pixel regions to provide the image data.

As the backlight module sequentially provides two primary color lights within any two successive frame times, the primary color lights in the first and the second sequence have brightness adjusted as $(L\mathbf{1}_{N+1}+L\mathbf{1}_N), L\mathbf{2}_N)$ and $((L\mathbf{3}_N+L\mathbf{3}_{N+1}), L\mathbf{2}_{N+1})$, respectively, after propagating through the display panel.

Moreover, the primary color lights include red light, blue light and green light. As the backlight module provides two primary color lights in each of the frame times, the time occupied for each primary color light can be the same or different.

In the third aspect, the display method for use in a display comprises a backlight module and a display panel. The backlight module is operative to provide M types of primary color lights (M is a positive integer no smaller than 4), and the display panel includes an array of pixel regions.

Firstly, the display method provides a plurality of image data to the pixel regions within a plurality of frame times. Each of the image data includes M types of primary color lights with brightness of $L1_N$, $L2_N$ to $LM_N$ of the first, second to $M^{th}$ type primary color lights in the $N^{th}$ frame time, where N is a positive integer.

Secondly, the display method provides M-1 types among the M types of the primary color lights to the pixel regions with a first color sequence and a second color sequence, so as to drive the pixel regions according to the image data. The first color sequence includes a first portion and a second portion in which a first primary color light of the M types of primary color light and the M-2 types of the remaining third primary color lights are provided, respectively. The second color sequence includes a third portion and a fourth portion to provide the second primary color light among the M types of primary color light and M-2 types of the remaining third primary color lights, respectively. The second portion providing the third primary color lights and the fourth portion providing the third primary color lights can have the same or difference sequence. As the backlight module sequentially provides M-1 primary color lights within any two successive frame times, the first and the second color lights have brightness adjusted as ($L1_{N-1}$+$L1_N$) and ($LM_N$+$LM_{N+1}$), respectively, after propagating through the display panel.

Moreover, the primary color lights, for example as M=4, may include red light, blue light, green light and cyan light As the backlight module provides M-1 types of primary color lights in each of the frame times, the time occupied for each primary color light can be the same or different.

The display method as provided does not save the fabrication time and cost for color filter thin films, but also enhances the spatial utilities of various primary colors. Further, the switching frequency between three primary lights can be lower than the display using array method Therefore, the technique threshold m fabricating the backlight module and the display panel is lowered, and the fabrication cost is reduced effectively.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

First Embodiment

Figure 1:
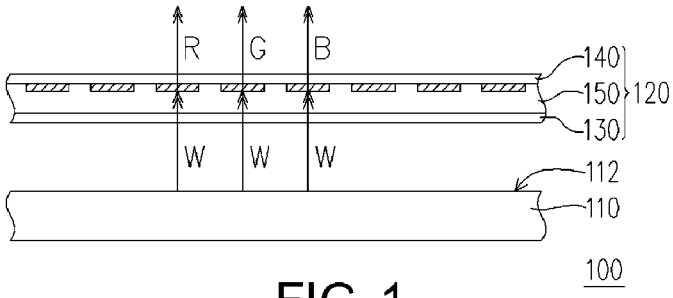
FIG. 1 Prior Art
FIG. 1 is a cross sectional schematic drawing showing the basic structure of a conventional liquid crystal display.
Figure 2:
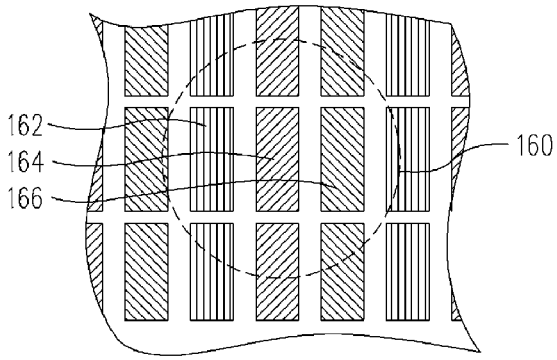
FIG. 2 Prior Art
FIG. 2 is a top view showing a conventional liquid crystal display.
Figure 3:
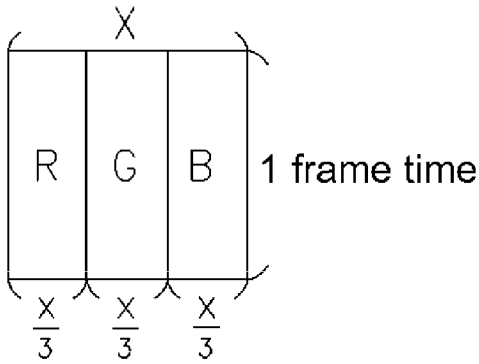
FIG. 3 Prior Art
FIG. 3 is a schematic drawing showing the display method of the conventional liquid crystal display.
Figure 4:
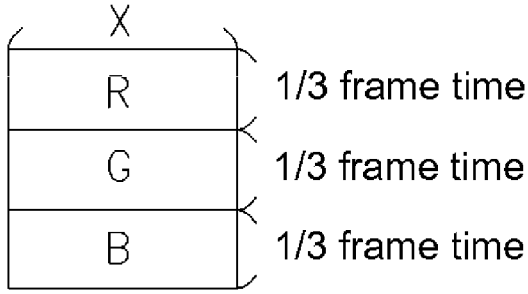
FIG. 4 Prior Art
FIG. 4 is a schematic drawing showing another conventional display method.
Figure 5:
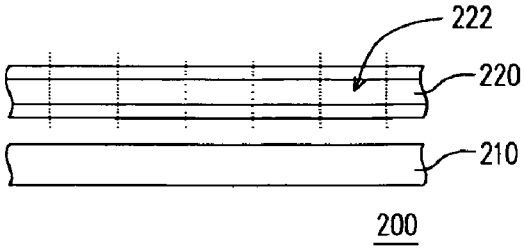
FIG. 5 is a cross sectional view showing a display using a novel display method as provided.

Referring to FIG. 5, the display 200 includes a backlight module 210 and a display panel 220. The backlight module 210 is suitable to provide three primary color lights, such as red light, blue light and green light. In this embodiment, the backlight module 210 may include a light emitting diode, a cold cathode fluorescent light or other light source suitable for high switching frequency between primary colors. This display panel 220 includes an array of a plurality of pixel regions 222. Each of the pixel regions 222 does not require a color filter thin film. Instead, the arrangement of the liquid crystal is used to determine the transmission rate, and the full color display can be obtained by primary color lights provided by the backlight module 210 transmitting through the liquid crystal with specific transmission rates.

Figure 6:
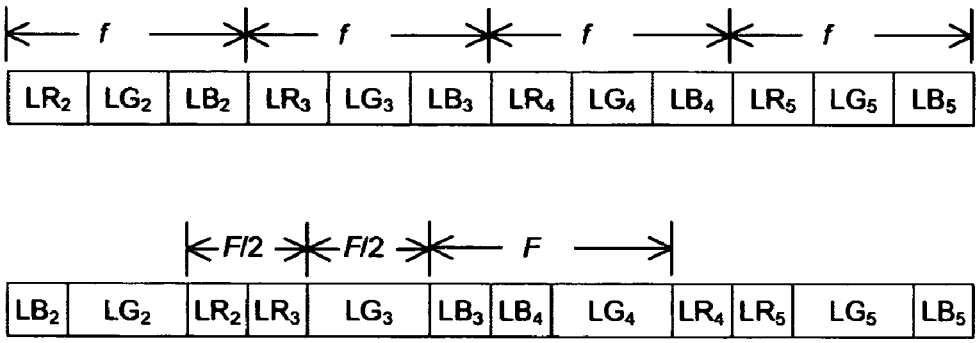
FIG. 6 shows a first embodiment of the display method.

Referring to FIG. 6, the display method provides a plurality of image data to be displayed by the respective pixel regions within a plurality of continuous frame times f. In the embodiment as shown in FIG. 6, four image data are to be displayed between the second frame time f to the fifth frame time f. Each of the four image data further includes the data images of $LR_N$, $LG_N$ and $LB_N$, which represent the brightness of red light, green light and the blue light for each pixel region at the $N^{th}$ frame time f, where N is a positive integer.

As shown in FIG. 6, when the sequence of providing each primary color light within every other frame time f is reversed, the same primary color light will be continuously provided by the backlight module between consecutive frame times f. Therefore, in this embodiment, the image data of the adjacent same primary color lights between two consecutive frame times f are rearranged to display within the same frame time f. The original frame time f is thus slightly modified into the new frame time F. As shown, the image data $LR_2$ of the original second time frame f is merged with the first two image data $LR_3$ and $LG_3$ into the new third frame time F, while the image data $LB_3$ of the original third frame time f is merged with the image data $LB_4$ and $LG_4$ into the new fourth frame time F. The remaining image data are also rearranged in the same manner.

It will be appreciated that the method is not limited to merging the last primary color light of one frame time f into the immediately following frame time f. Other arrangement such as merging the first primary color light of the next frame time f into the previous frame time f may also be adapted to form the new frame time F. The rearrangement is determined by the definition of the new frame time F. In addition, the sequence of the three primary color lights is not limited to R/G/B either. Other sequences may also be applied according to specific requirements.

In this manner, only two of the three primary color lights are provided by the backlight module within two consecutive time frames F, that is, only the first sequence (R.G) and the second sequence (B,G) are provided in this embodiment.

Thereby, assuming that an old frame time f or a new frame time F is scanned with a frequency 60 Hz within each pixel region, the color switching frequency of the backlight module is 180 Hz, while the color switching frequency of the embodiment as discussed above is reduced to 120 Hz. That is, the scan frequency can be reduced with ⅓ of that of the conventional method, such that the load of the driving chip of the pixel regions is decreased. In the example of a liquid crystal display, the distribution of the liquid crystal will not be restricted to the expensive optically self-compensated birefringence (OCB) liquid crystal that has faster response time.

In addition, as the backlight module provides two primary color lights (such as R,G or B,G) within each frame time p; the time occupied for each primary color light may be the same or different.

To allow the rearranged image data retaining the same display effect as the original arrangement of the image data, the primary color lights of the backlight are provided with a fist sequence and a second sequence within any two consecutive frame times F, respectively. The displayed brightness propagating through the pixel regions is denoted as $((LR_{N-1}+LR_N), LG_N)$ and $(LB_N+LB_{N+1}), LR_{N+1})$, respectively. Thereby, the ideal white balance can be obtained. It will be appreciated such brightness relationship between the primary color lights is only one of many available options. For example, to achieve above effect, the backlight module may double the brightness of the red light and blue light, while the corresponding transmission rate of the red light and the green light can be derived from the average value between the brightness of two consecutive red or blue light, for example, the averaged brightness of $LR_{N-1}$, $LR_N$ and $LB_N$ and $LB_{N-1}$. As the brightness of the red and blue light has been doubled by the backlight module, the same display effect can thus be obtained.

Second Embodiment

Figure 7:
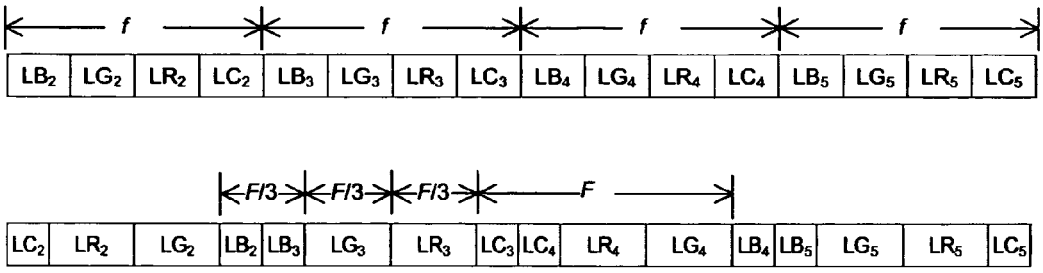
FIG. 7 shows a second embodiment of the display method.

Referring to FIG. 7, the second embodiment differs from the first embodiment by providing at least four primary color lights, while the remaining portions or steps are the same. The description of the same part is thus not repeated again.

In this embodiment, the data image to be displayed at each pixel region within a plurality of continuous frame times f are provided. In FIG. 7, four images to be displayed from the second frame time f to the fifth frame time f. Each of the image data includes $(L\mathbf{1}_N, L\mathbf{2}_N, \ldots, LM_N)$, which indicate the brightness of the $M^{th}$ primary color light to be displayed in the $N^{th}$ frame time f, where N is a positive integer. In this embodiment, M=4, and $L\mathbf{1}_N$, $L\mathbf{2}_N$, $L\mathbf{3}_N$ and $L\mathbf{4}_N$ are $LC_N$, $LR_N$, $LG_N$ and $LB_N$.

The backlight module provides M-1 types of primary color lights with the first sequence of (1,2, . . . , M-1) and the second sequence (M, M-1, . . . , 2) for the N frame times f. Again, 1, 2, . . . ,M-1 indicate the different primary color lights. The pixel regions are thus driven according to the image data. Thereby, the similar effect of the first embodiment can be achieved. That is, the scan frequency for each pixel region is reduced as (M-1)/M times of the original scan frequency. When the scan frequency is 60 Hz for each frame time F of the four-color system, the color switching frequency for the backlight module is thus reduced from 240 Hz to 180 Hz.

In this embodiment, as the backlight module provides the M-1 types of primary color lights with the first and second sequences for the consecutive frame times F, the displayed brightness of the pixel regions can be adjusted as $((L\mathbf{1}_{N+1}+L\mathbf{1}_N), L\mathbf{2}_N, \ldots, L(M\text{-}1)_N)$ and $((LM_N+LM_{N+1}), L(M\text{-}2)_{N+1}, \ldots, L\mathbf{2}_{N+1})$.

The four primary color lights include red light, blue light, green light and cyan light in this embodiment Although M=4 is applied in the second embodiment as shown in FIG. 7, M can also be any positive integer larger than 4. For example, a fifth primary color can also be used in the display method for the backlight module of the liquid crystal display as described above.

Third Embodiment

Figure 8:
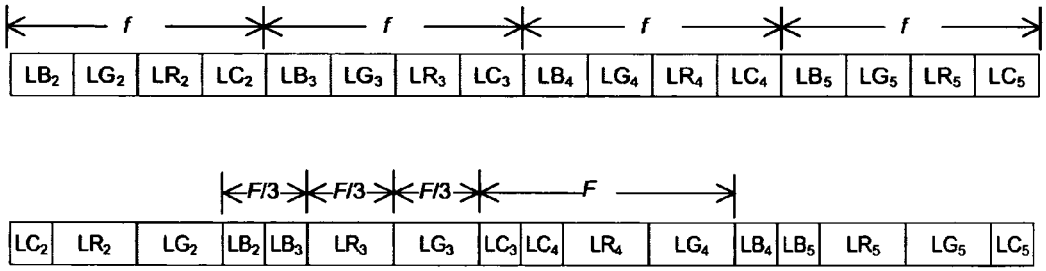
FIG. 8 shows a third embodiment of the display method.

Referring to FIG. 8, the third embodiment differs from the second embodiment by the sequence for providing the M-2 types of primary color lights between any two consecutive frame times. The remaining steps of method provided in the third embodiment are the same as those in the second embodiment, such that the repetitive description will not be provided again.

In this embodiment, M-2 types of primary color lights (R, G) are provided in each of the consecutive frames F with the same sequence.

In other words, when the display method applied to the backlight module provides five types of primary color lights, the M-2 types of primary color lights are provided to each consecutive frame time with the same or different sequence, which does not have to be opposite or reversed from each other.

Accordingly, the display methods provided above obtains the full color effect by integrating the primary color backlight, such that the cost and labor required for fabricating color filter thin films are saved. In addition, each primary color light is emitted from the surface area of all the pixel regions, such that the spatial utility for each primary color light is improved. In addition, as the types of the primary color lights provided in each consecutive frame times are less than that provided by the backlight module by one, the color switching frequency for each frame time is thus reduced. Thereby, the technique threshold for fabricating the backlight module and the liquid crystal display is lowered, and the fabrication cost is effectively reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A display method, suitable for use in a display comprising a backlight module operative to provide M types of primary color lights (M is a positive integer no smaller than 3) and a display panel including an array of a plurality of pixel regions, the display method comprising:

providing a plurality of image data to each of the pixel regions within N frame times (N is a positive integer), wherein each of the image data provided to the $N^{th}$ frame time includes M types of primary color lights with brightness expressed as $L\mathbf{1}_N, L\mathbf{2}_N, \ldots, LM_N$; and rearranging the M types of primary color lights provided to the consecutive frame times, such that each of the frame times includes only M-1 types of primary color lights, and the M-1 types of primary color lights are provided with alternate color sequences of 1, 2, . . . , M-1 and M, M-1, . . . , 2 for the first to the $N^{th}$ frame time to drive the pixel regions.

2. The driving method of claim 1, wherein as the backlight module sequentially provides M-1 primary color lights within any two successive frame times, the primary color lights in the first and the second sequence have brightness adjusted as $(L\mathbf{1}_{N+1}+L\mathbf{1}_N), L\mathbf{2}_N, \ldots, L(M\text{-}1)_N)$ and $((LM_N+LM_{N+1}), L(M\text{-}1)_{N+1}, \ldots, L\mathbf{2}_{N+1})$, respectively, after propagating through the display panel.

3. The driving method of claim 1, wherein M=4.

4. The driving method of claim 3, wherein the primary color lights include red light, blue light, green light and cyan light.

5. The driving method of claim 1, wherein as the backlight module provides M-1 types of primary color lights in each of the frame times, the time occupied for each primary color light is the same.

6. The driving method of claim 1, wherein as the backlight module provides M-1 types of primary color lights in each of the frame times, the time occupied for each primary color light is different.

7. A display method suitable for use in a display that has a backlight module and a display panel, wherein the backlight module is operative to provide at least a first, a second and a third primary color lights, and the display panel comprises an array of a plurality of pixel regions, the display method comprises:

providing a plurality of image data to the pixel regions within a plurality of frame times, wherein the each of the image data includes a brightness $L1_N$, $L2_N$, $L3_N$ at the pixel regions for the $N^{th}$ time frame, where N is a positive integer; and providing the three primary color lights to the frame times with the sequence of first color, second color and sequence of third color, second color sequentially and driving the pixel regions to provide the image data.

8. The driving method of claim 7, wherein as the backlight module sequentially provides two primary color lights within any two successive frame times, the primary color lights in the first and the second sequence have brightness adjusted as $(L1_{N+1}+L1_N)$, $L2_N)$ and $((L3_N+L3_{N+1})$, $L2_{N+1})$, respectively, after propagating through the display panel.

9. The driving method of claim 7, wherein the primary color lights include red light, blue light, and green light.

10. The driving method of claim 7, wherein as the backlight module provides two primary color lights in each of the frame times, the time occupied for each primary color light is the same.

11. The driving method of claim 7, wherein the backlight module provides two primary color lights in each of the frame times, the time occupied for each primary color light is different.

12. A display method suitable for use in a display that comprises a backlight module and a display panel, wherein the backlight module is operative to provide M types of primary color lights (M is a positive integer no smaller than 4), and the display panel includes an array of pixel regions, the method comprising:

providing a plurality of image data to the pixel regions within a plurality of frame times, wherein each of the image data includes M types of primary color lights with brightness of $L1_N$, $L2_N$ to $LM_N$ of the first, second to $M^{th}$ type primary color lights in the $N^{th}$ frame time, where N is a positive integer; and providing M-1 types among the M types of the primary color lights to the pixel regions with a first color sequence and a second color sequence, so as to drive the pixel regions according to the image data, wherein the first color sequence includes a first portion and a second portion in which a first primary color light of the M types of primary color light and the M-2 types of the remaining third primary color lights are provided, respectively, the second color sequence includes a third portion and a fourth portion to provide the second primary color light among the M types of primary color light and M-2 types of the remaining third primary color lights, respectively.

13. The driving method of claim 12, wherein the second portion providing the third primary color lights has the same sequence as that of the fourth portion providing the third primary color lights.

14. The driving method of claim 12, wherein the second portion providing the third primary color lights has different sequence from that of the fourth portion providing the third primary color lights.

15. The driving method of claim 12, wherein as the backlight module sequentially provides M-1 primary color lights within any two successive frame times, the first and the second color lights have brightness adjusted as $L1_{N-1}+L1_N$ and $LM_N+LM_{N+1}$, respectively, after propagating through the display panel.

16. The driving method of claim 12, wherein M=4.

17. The driving method of claim 16, wherein the primary color lights include red light, blue light, green light and cyan light.

18. The driving method of claim 12, wherein as the backlight module provides the M-1 types of primary color lights in each of the frame times, the time occupied for each primary color light is the same.

19. The driving method of claim 12, wherein as the backlight module provides the M-1 types of primary color lights in each of the frame times, the time occupied for each primary color light is different.

* * * * *